US006726064B2

(12) United States Patent
Bonningue

(10) Patent No.: US 6,726,064 B2
(45) Date of Patent: Apr. 27, 2004

(54) PUMP FOR DISPENSING A SUBSTANCE, IN PARTICULAR A COSMETIC OR A CARE PRODUCT

(75) Inventor: Philippe Bonningue, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/993,539

(22) Filed: Nov. 6, 2001

(65) Prior Publication Data

US 2002/0100772 A1 Aug. 1, 2002

(30) Foreign Application Priority Data

Nov. 7, 2000 (FR) ..... 00 14290

(51) Int. Cl.[7] ..... B65D 88/54

(52) U.S. Cl. ..... 222/321.9; 222/321.7; 222/153.13; 222/384

(58) Field of Search ..... 222/153.01, 321.2, 222/321.1, 321.7, 321.9, 153.13, 384, 385, 481.5, 153.09

(56) References Cited

U.S. PATENT DOCUMENTS

| | | | | |
|---|---|---|---|---|
| 1,586,170 A | | 5/1926 | White | |
| 3,062,416 A | | 11/1962 | Cooprider | |
| 3,228,347 A | | 1/1966 | Corsette | |
| 3,759,426 A | * | 9/1973 | Kane et al. | 222/385 |
| 3,949,906 A | | 4/1976 | Pettersen et al. | |
| 4,183,449 A | * | 1/1980 | Blake | 222/321.2 |
| 4,317,531 A | * | 3/1982 | Saito et al. | 222/321.2 |
| 4,344,744 A | | 8/1982 | Schuster et al. | |
| 4,365,729 A | * | 12/1982 | Saito et al. | 222/321.2 |
| 4,375,266 A | * | 3/1983 | Magers | 222/153.13 |
| 4,462,549 A | * | 7/1984 | Saito et al. | 239/333 |
| 4,923,094 A | * | 5/1990 | O'Neill | 222/321.2 |
| 4,991,746 A | * | 2/1991 | Schultz | 222/153.13 |
| 4,991,747 A | * | 2/1991 | Van Brocklin | 222/321.3 |
| 5,029,495 A | * | 7/1991 | Rosenberger | 81/3.09 |
| 5,234,135 A | * | 8/1993 | LaFosse et al. | 222/321.2 |
| 5,492,251 A | * | 2/1996 | Albini et al. | 222/153.13 |
| 5,655,688 A | | 8/1997 | Moore | |
| 5,738,250 A | * | 4/1998 | Gillingham et al. | 222/153.13 |
| 5,775,547 A | * | 7/1998 | Foster et al. | 222/321.3 |
| 5,850,948 A | * | 12/1998 | Garcia et al. | 222/321.9 |
| 5,899,363 A | * | 5/1999 | Bliss et al. | 222/153.02 |
| 6,036,059 A | * | 3/2000 | VanBrocklin | 222/321.9 |
| 6,050,457 A | * | 4/2000 | Arnold et al. | 222/321.9 |
| 6,206,245 B1 | * | 3/2001 | Bonningue | 222/321.7 |
| 6,209,761 B1 | * | 4/2001 | Bonningue | 222/321.7 |

FOREIGN PATENT DOCUMENTS

| | | |
|---|---|---|
| EP | 0 906 868 A2 | 4/1999 |
| FR | 2 725 921 | 10/1994 |
| FR | 2 781 463 | 1/2000 |
| GB | 1158058 | 2/1967 |
| GB | 2 141 186 | 12/1984 |

* cited by examiner

*Primary Examiner*—Gene Mancene
*Assistant Examiner*—Frederick C. Nicolas
(74) *Attorney, Agent, or Firm*—Pearne & Gordon LLP

(57) ABSTRACT

A pump for fixing onto a receptacle to dispense a substance contained therein. The pump has a pump body that includes at least one air intake vent. A pushbutton is movable relative to the pump body between a low position and a high position. A suction valve includes a shutter-forming member. A piston co-operates with the pump body to define a pump chamber of variable volume. Also, a dispenser duct is provided through which the pump chamber can communicate with a dispenser orifice. A sealing skirt surrounds the dispenser duct on at least a fraction of the height of the dispenser duct. The sealing skirt is configured to co-operate with the pump body when the pushbutton is in its low position so as to isolate the vent from an outside ambient environment. As examples of a few aspects, the dispenser duct is provided as an element attached to the pushbutton and the piston is movable relative to the dispenser duct.

98 Claims, 3 Drawing Sheets

PUMP FOR DISPENSING A SUBSTANCE, IN PARTICULAR A COSMETIC OR A CARE PRODUCT

The present invention relates to a pump to dispense a substance contained in a receptacle.

BACKGROUND OF THE INVENTION

U.S. Pat. No. 3,062,416 discloses a pump that has a pump body for fixing onto a receptacle and including at least one air intake vent. A pushbutton is movable relative to the pump body between a low position and a high position. A suction valve includes a shutter-forming member. A piston co-operates with the pump body to define a pump chamber of variable volume. A dispenser duct is provided through which the pump chamber can communicate with a dispenser orifice. The piston is made integrally with the pushbutton by molding.

The pushbutton can be screwed into the pump body in the low position for storage purposes.

The pump is then sealed by the pushbutton pressing against a conical surface of the pump body. Such a pump is relatively complex and difficult to make.

French patent application No. FR-A-2 447 473 discloses a pump in which the piston is attached to the pushbutton. Such a pump does not include means for holding the pushbutton in the low position when not in use, unlike the pump described in above-cited U.S. Pat. No. 3,062,416. The pump is sealed only when in the high position.

OBJECTS AND SUMMARY OF THE INVENTION

There exists a need for a pump having a relatively small number of component parts and that is easy to manufacture.

There also exists a need for a pump in which the air intake vent is isolated from the outside during storage.

According to one aspect of the invention, the pump comprises a body for fixing onto a receptacle and including at least one air intake vent; a pushbutton movable relative to the pump body between a low position and a high position; a suction valve including a shutter-forming member; a piston co-operating with the pump body to define a pump chamber of variable volume; and a dispenser duct through which the pump chamber can communicate with a dispenser orifice. The pushbutton may further comprise a sealing skirt surrounding the dispenser duct on at least a fraction of its height, said sealing skirt being suitable for bearing in a leak tight manner against the pump body when the pushbutton is in its low position so as to isolate the vent from the outside. The dispenser duct may be constituted by an element attached to the pushbutton.

The pump may be manufactured relatively easily, since it may not require any parts that are complex in shape.

The piston may be implemented as an attachment.

Also, the sealing skirt may be made integrally with the pushbutton.

The piston is advantageously arranged to isolate the vent when the pushbutton is in its high position.

For this purpose, the piston may include two annular sealing lips suitable for bearing respectively above and below the vent when the pushbutton is in its high position.

The delivery duct may be suitable for coming to bear against the shutter-forming member of the suction valve when the pushbutton is in its low position.

The suction valve is thus held closed, thereby reducing the risk of leaks while the pump is being transported.

The pump advantageously includes a spring placed in the pump chamber so as to exert a return force on the pushbutton urging it towards its high position.

The shutter-forming member of the suction valve can be constituted, for example, by a ball held in a cage that is formed integrally with the pump body, the cage including at least one elastically deformable retention member capable of deforming while the ball is being put into place.

In a particular embodiment of the invention, the delivery duct is formed integrally with the piston and cannot move relative thereto.

Under such circumstances, the pump advantageously includes a delivery valve comprising a shutter-forming member retained in a housing made in the dispenser duct.

Such a shutter-forming member can be constituted by a ball, for example.

The housing receiving the shutter-forming member of the delivery valve can be situated in the top portion of the dispenser duct.

The shutter-forming member of the delivery valve can be urged against a seat formed in the dispenser duct by a spring that bears against the pushbutton.

The shutter-forming member of the delivery valve can alternatively be left free in its housing.

Under such circumstances, the pushbutton advantageously forms a top seat for the shutter-forming member of the delivery valve, which member comes to bear against said top seat in the event of the receptacle being turned upside-down, in the event of negative pressure outside the pump, or in the event of substance being dispensed too quickly.

The dispenser duct may form a bottom seat against which the shutter-forming member of the delivery valve can come to bear when negative pressure is created in the pump chamber, in normal operation of the pump.

The housing receiving the shutter-forming member of the delivery valve can also be situated in the bottom portion of the dispenser duct.

In another particular embodiment of the invention, the dispenser duct includes a substance admission orifice opening out laterally, and the piston is movable relative to the dispenser duct between a closed position in which it closes the admission orifice and a dispensing position in which the admission orifice is open.

The dispenser duct may include a top abutment suitable for limiting upward displacement of the piston relative to the dispenser duct, and a bottom abutment suitable for limiting downward displacement of the piston relative to the dispenser duct, and one of the abutments is arranged in such a manner as to enable the piston to go past it when the piston is put into place on the dispenser duct.

This can be the top abutment, for example, which is then suitable for allowing the piston to go past it when the piston is moved towards the bottom abutment while it is being put into place on the dispenser duct.

The pump body may be made integrally with an assembly skirt enabling it to be fixed on the receptacle.

Also, the pump body may include a first retaining member and the pushbutton includes a second retaining member suitable for co-operating with the first to hold the pushbutton in its low position during storage.

In accordance with another aspect, the invention also provides a pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct having a height and permitting communication from the pump chamber to a dispenser orifice;

wherein the pushbutton comprises a sealing skirt surrounding the dispenser duct on at least a fraction of the height of the dispensing duct, the sealing skirt being configured to cooperate with the pump body when the pushbutton is in its low position so as to isolate the vent from an outside ambient environment, and wherein the piston is movable relative to the dispenser duct.

In accordance with another aspect, the invention also provides a pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct having a height and permitting communication from the pump chamber to a dispenser orifice;

wherein the pushbutton comprises a sealing skirt surrounding the dispenser duct on at least a fraction of the height of the dispenser duct, the sealing skirt being configured to cooperate with the pump body when the pushbutton is in its low position so as to isolate the vent from an outside ambient environment, wherein the dispenser duct comprises an element attached to the pushbutton, and wherein the high position of the pushbutton is determined by the cooperation of the pushbutton and the pump body.

In accordance with another aspect, the invention also provides a pump to dispense a substance contained in a receptacle, the pump comprising:

a pump body including at least one air intake vent;

a pushbutton movable relative to the pump body between a low position and a high position;

a suction valve including a ball;

a piston co-operating with the pump body to define a pump chamber of variable volume; and a dispenser duct attached to the pushbutton and not integral therewith, having a height and permitting communication from the pump chamber to a dispenser orifice;

wherein the pushbutton comprises a sealing skirt surrounding the dispenser duct on at least a fraction of the height of the dispenser duct, the sealing skirt being configured to cooperate with the pump body when the pushbutton is in its low position so as to isolate the vent from an outside ambient environment.

In accordance with another aspect, the invention also provides a pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct attached to the pushbutton and not integral therewith, having a height and permitting communication from the pump chamber a dispenser orifice of the dispensing duct;

wherein the pushbutton comprises a locking skirt capable of cooperating with the body to lock the pushbutton in the low position and a sealing skirt located between the locking skirt and the dispenser duct and surrounding the dispenser duct on at least a fraction of the height of the dispensing duct, the sealing skirt being configured to cooperate with the pump body when the pushbutton is in its low position so as to isolate the vent from an outside ambient environment.

In accordance with another aspect, the invention also provides a pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct attached to the pushbutton and not integral therewith, having a height and permitting communication from the pump chamber to a dispenser orifice;

a delivery valve comprising a ball;

wherein the pushbutton comprises a sealing skirt surrounding the dispenser duct on at least a fraction of the height of the dispenser duct, the sealing skirt being configured to cooperate with the pump body when the pushbutton is in its low position so as to isolate the vent from an outside ambient environment.

In accordance with another aspect, the invention also provides a method of manufacturing a pump, wherein the pump comprising: a pump body for fixing on the receptacle and including at least one air intake vent; a pushbutton movable relative to the pump body between a low position and a high position; a suction valve including a shutter-forming member; a piston co-operating with the pump body to define a pump chamber of variable volume; and a dispenser duct through which the pump chamber can communicate with a dispenser orifice, the pushbutton further comprising a sealing skirt surrounding the dispenser duct on at least a fraction of its height, the sealing skirt configured to cooperate with the pump body when the pushbutton is in its low position so as to isolate the vent from an outside ambient environment, and the dispenser duct including an element attached to the pushbutton; the method comprising the following steps:

a) forming the sealing skirt integrally with the pushbutton; and b) attaching the dispenser duct to the pushbutton after mounting a piston on the dispenser duct that is movable relative to the dispenser duct or after inserting into the dispenser duct a member forming a shutter for a delivery valve.

The invention also provides a receptacle fitted with a pump as defined above.

BRIEF DESCRIPTION OF THE DRAWINGS

Other characteristics and advantages of the present invention will appear on reading the following detailed description of non-limiting embodiments and on examining the accompanying drawings, in which.

MORE DETAILED DESCRIPTION

Figure 1:
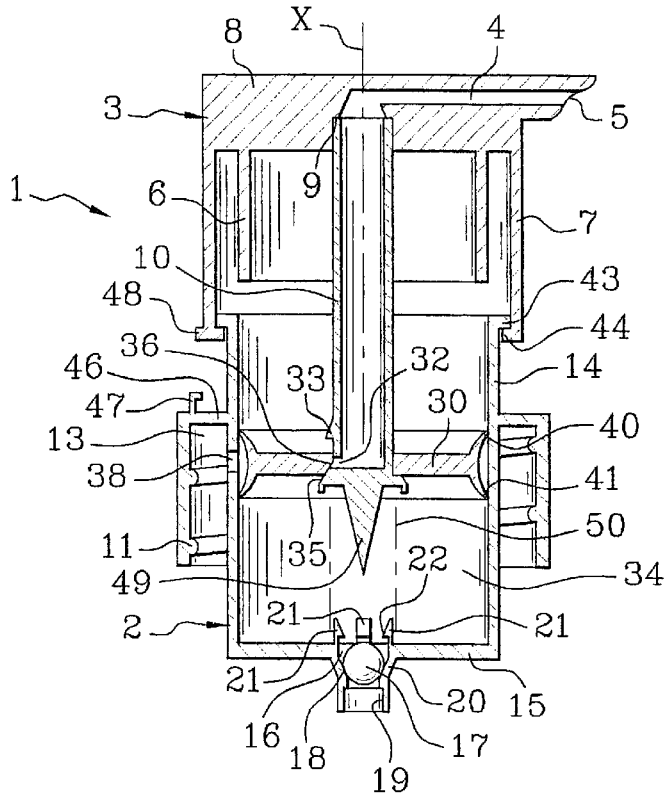
FIGS. 1 to 3 are diagrammatic axial sections through a pump constituting a first embodiment of the invention, the pump being shown in various positions.
Figure 2:
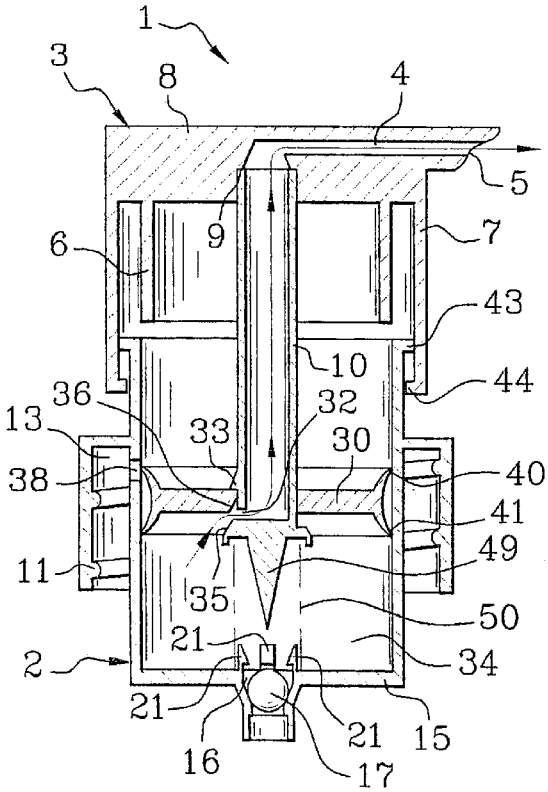
Figure 3:
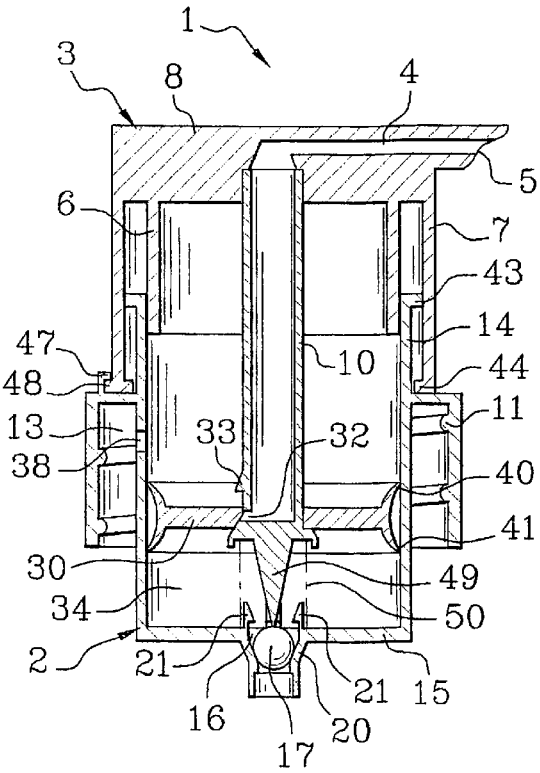

The pump 1 shown in FIGS. 1 to 3 is for fixing on a receptacle (not shown) that contains a liquid substance.

The pump 1 comprises a pump body 2 and a pushbutton 3 movable along an axis X relative to the pump body 2.

A body 8 of the pushbutton 3 is provided with an outlet channel 4 opening out at one end 5 to the outside in order to dispense the liquid.

The pushbutton 3 also has a sealing skirt 6 and a locking skirt 7 formed integrally with the body 8 and having functions that are described in greater detail below.

The body 8 has a housing 9 on the axis X for fixing a dispenser duct 10, likewise on the axis X. The dispenser duct 10 engages the body 8 such that an upper orifice of the dispenser duct opens to the outlet channel 4.

The pump body 2 is made integrally with an assembly skirt 11 having an inside thread for screwing onto a neck of the receptacle.

The assembly skirt 11 is connected to the pump body 2 by a ring of material 46.

A gasket can be placed in the end of a slot 13 defined between the assembly skirt 11 and the pump body 2 so as to seal the connection between the pump body 2 and the neck of the receptacle.

In a variant, the neck of the receptacle can have a bearing surface at its top end which is pressed in a leak tight manner against the pump body 2.

The pump body 2 includes a vent 38 situated below the level of the ring of material 46.

In this case, the pump body 2 has a cylindrical wall 14 about the axis X and an end wall 15 that is generally perpendicular to the axis X.

The center of the end wall 15 is formed with an endpiece 18 whose bottom portion is used for mounting a dip tube (not shown). The endpiece 18 has a shoulder 19 against which the top end of the dip tube can come to bear.

Above the shoulder 19, the endpiece 18 also includes a frustoconical wall 20 that forms a seat against which a ball 17 can come to bear.

Resilient tabs 21 made integrally with the end wall 15 form a cage 16 in which the ball 17 is retained or entrapped.

The tabs 21 are provided at their top ends with respective catches 22 that prevent the ball 17 from leaving the cage 16, and they are suitable for deforming elastically while the ball 17 is being inserted into the cage 16.

The ball 17 constitutes the shutter-forming member of a suction valve, as described in greater detail below.

In a variant not shown, the ball 17 can be retained in its housing by means of a return spring 50 (described below).

A piston 30 is mounted on the dispenser duct 10 and is capable of sliding relative thereto.

The piston 30 co-operates with the cylindrical wall 14 and the end wall 15 to define a pump chamber 34.

The dispenser duct 10 has an admission orifice 32 opening out sideways and the piston 30 can move between a dispensing position in which it bears against a top abutment 33, as shown in FIG. 2, with the admission orifice 32 then being disengaged, and a position for filling the pump chamber 34 in which the piston 30 closes the admission orifice 32, as can be seen in FIG. 1.

A conical surface 35 is located immediately beneath the admission orifice 32 and the piston 30 has a complementary conical surface 36 suitable for bearing against the surface 35 when the piston is in its closed position.

At its periphery, the piston 30 has two annular sealing lips 40 and 41 bearing in a leak tight manner against the tubular wall 14.

The spacing between the annular lips 40 and 41 is selected in such a manner as to cause them to be situated respectively above and below the vent 38 when the pushbutton is in its high position, as shown in FIG. 1.

In this high position, the locking skirt 7 comes to bear on an inwardly-directed rim 44 by means of an outwardly-directed flange 43 formed at the top end of the tubular wall 14.

The pump 1 includes a spring 50 working in compression, having one axial end bearing against the end wall 15 and its opposite axial end bearing against the dispenser duct 10.

The ring of material 46 is provided with a first locking member 47 and the locking skirt 7 has a second locking member 48 suitable for co-operating therewith when the pushbutton 3 is in its low position, as shown in FIG. 3.

In the embodiment described, the first locking member 47 is constituted by a hook directed towards the axis X while the second locking member 48 is constituted by an outwardly-directed flange suitable for being brought under the above-mentioned hook by turning the pushbutton 3 relative to the pump body 2.

It should be observed that the section plane of FIG. 2 does not contain the hook 47 or the flange 48.

In a variant (not shown), the first and second locking members can be constituted by complementary threads.

The dispenser duct 10 has an extension 49 at its bottom end extending downwards along the axis X and suitable for coming into abutment against the ball 17 when the pushbutton 3 is in its low position, as shown in FIG. 3.

The pump 1 operates as follows.

It is assumed that the pump is primed, i.e. that the pump chamber 34 is full of liquid.

To dispense the liquid, the user presses the pushbutton 3 into the pump body 2.

The piston 30 comes to bear against the top abutment 33 and the admission orifice 32 is disengaged.

The liquid can penetrate into the dispenser duct 10 and the outlet channel 4, as shown in FIG. 2.

The ball 17 of the suction valve is kept pressed against its seat 20 by the pressure of the liquid in the pump chamber 34 and it prevents any liquid returning into the receptacle.

The pushbutton 3 continues its down stroke until the locking skirt 7 comes to bear against the ring of material 46, the pushbutton 3 then being in an orientation relative to the pump body 2 such that the locking members 47 and 48 do not co-operate.

The down stroke of the pushbutton 3 compresses the spring 50.

It will be observed that the vent 38 is open, the annular lip 40 bearing against the tubular wall 14 below it so that air can be taken in through the vent 38 and via the clearance that exists between the locking skirt 7 and the pump body 2. The sealing skirt 6 does not bear in a leak tight manner against the tubular wall 14 until the pushbutton 3 has reached the end of its down stroke.

When the user releases the pushbutton 3, the spring 50 relaxes and returns the pushbutton upwards.

The piston 30 then moves relative to the dispenser duct 10 until it comes to bear against the conical surface 35 and closes the admission orifice 32.

The volume of the pump chamber 34 increases under the effect of the spring 50 relaxing and liquid is sucked into the pump chamber, with the ball 17 being lifted off its seat on the frustoconical wall 20.

When the pump 1 is at rest in its high position (FIG. 1), the piston 30 closes the admission orifice 32 of the dispenser duct 10 to prevent flow through the orifice. Also, with the pump 1 at the rest position, the sealing lips 40, 41 of the piston 30 isolate the vent 38 from the bulk of the volume bounded by the cylindrical wall. Such isolation prevents airflow through the vent from the outside ambient environment.

Thus, the inside of the receptacle is isolated from the outside, thereby enabling the liquid to be conserved under good conditions.

In order to put the pump 1 into a storage configuration, the user presses the pushbutton 3 so as to bring the locking skirt 7 into abutment against the ring of material 46. The user then turns the pushbutton 3 through one-fourth of a turn, for example, relative to the pump body 2 so as to bring the flange 48 under the hook 47.

The hook then holds the locking skirt 7 in place and the pushbutton 3 in its low position, as shown in FIG. 3.

In this low position, the extension 49 on the dispenser duct 10 presses the ball 17 against its seat provided by the frustoconical wall 20. Also, in the low position, the sealing skirt 6 bears, in a leak tight manner, against the cylindrical wall 14 so that the interior of the cylindrical wall is isolated from the outside ambient environment. As such, the vent 38 is isolated from the outside ambient environment.

While the above-described pump 1 is being assembled, the piston 30 is engaged on the dispenser duct 10 before the duct is fixed to the pushbutton 3.

The top abutment 33 is arranged in such a manner as to allow the piston 30 to go past it in elastic manner when the piston is moved towards the bottom abutment provided by the conical surface 35.

Figure 4:
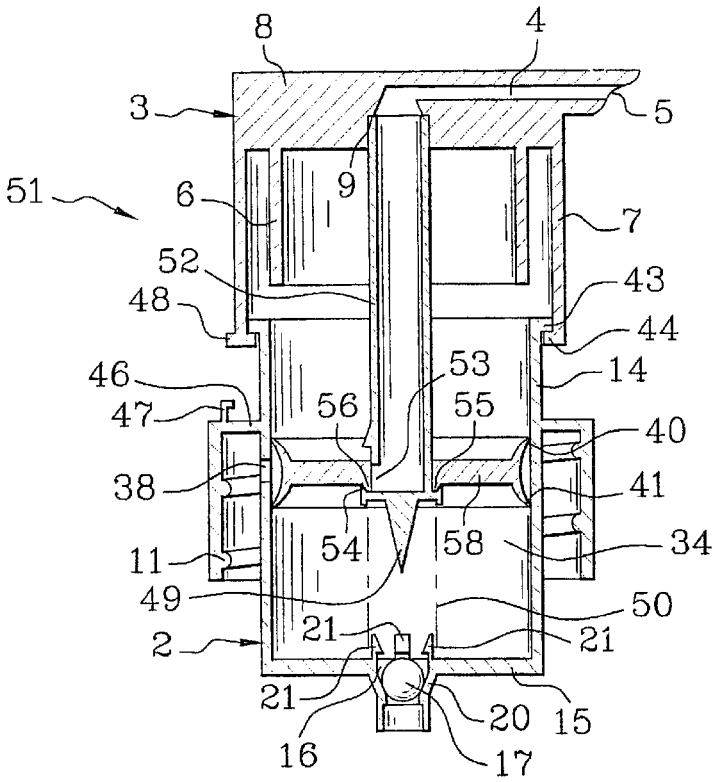
FIGS. 4 to 7 are diagrammatic axial section views showing variant embodiments of the invention.

The pump 51 shown in FIG. 4 has certain elements and structures that are identical to corresponding elements and structures of the embodiment of FIGS. 1–3. The identical elements and structures are identified by identical reference numerals. For example, the pump 51 has a pump body 2 and a pushbutton 3 that are identical to those described above. The pump 51 (FIG. 5) has a dispenser duct 52 with an admission orifice 53 that opens out laterally, being immediately above an annular wall 54 which defines an upwardly-diverging conical surface 55.

The pump 51 also has a piston 58 with an annular lip 56 suitable for bearing in a leak tight manner against the annular wall 54 when in its closed position.

The pump shown in FIG. 4 thus differs from the previously described pump in the shape of the bottom portion of the dispenser duct 52 and in the shape of the central portion of the piston 58 which co-operates therewith.

Figure 5:
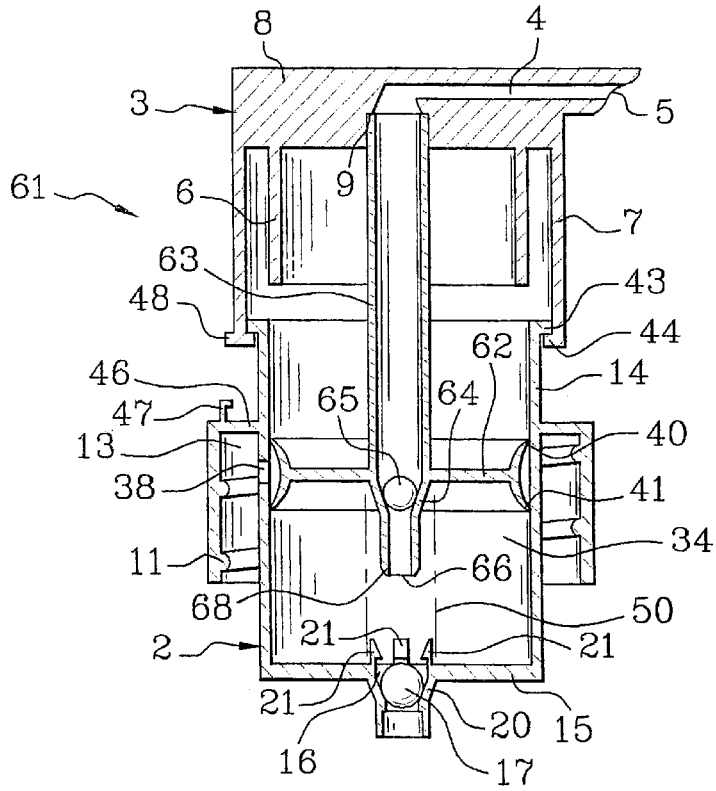

The pump 61 shown in FIG. 5 has certain elements and structures that are identical to corresponding elements and structures of the embodiments of FIGS. 1–3 and 4. The identical elements and structures are identified by identical reference numerals. The pump 61 (FIG. 5) differs from the above-described pumps in that it has a piston 62 which is formed integrally with a dispenser duct 63.

At its periphery, the piston 62 has two annular lips 40 and 41, like the piston 30 described above.

The dispenser duct 63 has a tapering section at its bottom end defining a seat 64 for a ball 65.

The ball 65 constitutes the shutter-forming member of a delivery valve suitable for opening under the pressure of liquid contained in the top chamber 34.

The dispenser duct 63 opens out downwards into the pump chamber 34 via an axial orifice 66 which is formed at the end of an annular lip 68 that converges inwards and downwards.

The bottom end of the spring 50 bears against the end wall 15 and its top end bears against the piston 62.

The pump 61 operates as follows.

When the user depresses the pushbutton 3, the volume of the pump chamber 34 decreases, the ball 65 is lifted inside the dispenser duct 63 and the ball 17 is pressed against its seat 20.

When the user releases the pushbutton 3, the suction created in the pump chamber 34 presses the ball 65 against its seat 64, while the ball 17 is lifted.

During assembly of the pump 61, the ball 65 is put into place inside the dispenser duct 63 and the duct is then fixed to the pushbutton 3.

It is to be noted that when the pump 61 is in its storage configuration, the annular lip 68 comes to bear against the ball 17, thus holding the ball pressed against its seat 20.

The pump 71 shown in FIG. 6, again with similar use of common numerals, differs from that described with reference to FIG. 5 in that a seat 72 for the ball 65 is formed toward the top of the dispenser duct 73.

The ball 65 is held pressed against its seat 72 by a spring 74 that operates in compression and that has its top end bearing against the pushbutton 3.

During assembly of the pump 71, the ball 65 is inserted into the dispenser duct 73, the spring 74 is put into place, and the dispenser duct 73 is fixed to the pushbutton 3.

Figure 6:
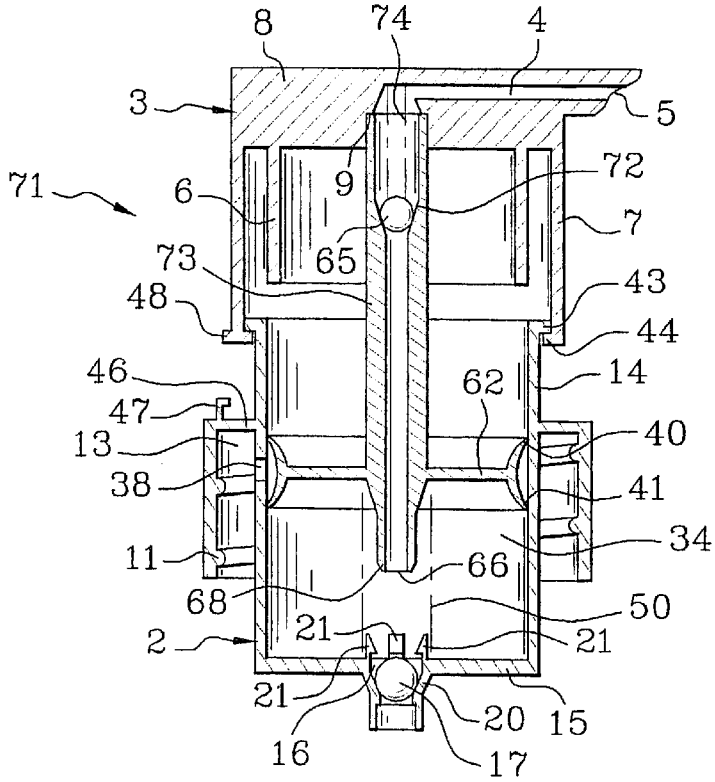
Figure 7:
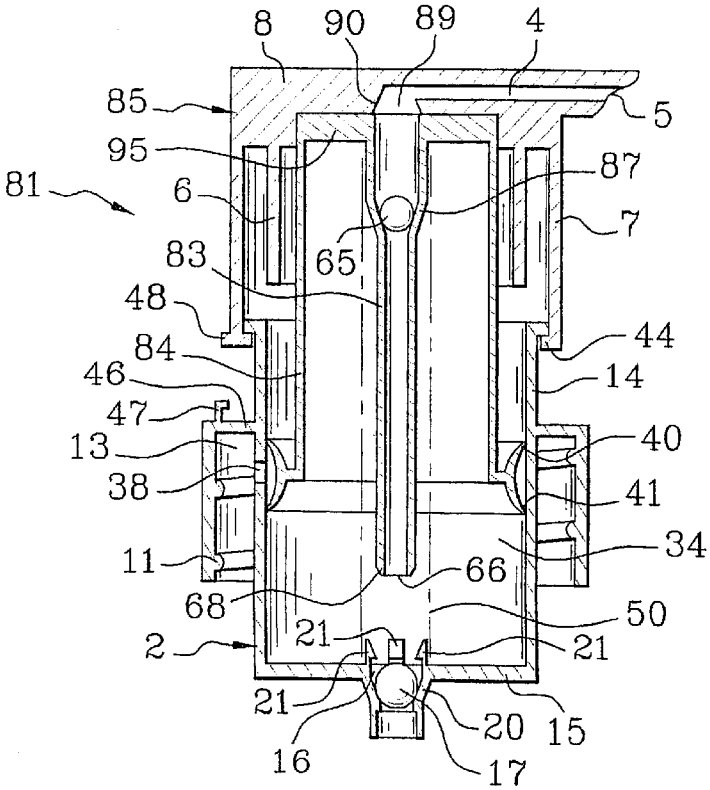

The pump 81 shown in FIG. 7, again with similar use of common numerals, differs from the pump described with reference to FIGS. 5 and 6 in that it has a dispenser duct 83 formed integrally with a tubular wall 84 whose bottom end carries the annular lips 40 and 41.

The unit constituted by the dispenser duct 83 and the tubular wall 64 is fixed to a pushbutton 85 which differs from the above-described pushbutton 3 merely by having a larger housing recess area for receiving the dispenser duct.

The dispenser duct 83 has a tapering inside section near its top end that defines a bottom seat 87 for the ball 65.

The outlet channel 4 communicates with the dispenser duct 83 via a funnel shape 89 presenting an upwardly converging frustoconical wall defining a top seat 90 against which the ball 65 can come to bear if the receptacle is turned upside-down, if the pressure outside the pump is negative, or if the liquid is being dispensed too quickly.

In this case, the bottom end of the spring 50 bears against the end wall 15 and its top end bears against a wall 95 interconnecting the tubular wall 84 and the dispenser duct 83.

Naturally, the invention is not limited to the embodiments described above.

In particular, the sealing skirt 6 of the embodiment shown in FIGS. 1 to 3 could be extended downwards so as to close the vent 38 when the pushbutton 3 is in its low position.

What is claimed is:

1. A pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct having a height and through which the pump chamber can communicate with a dispenser orifice;

wherein the pushbutton further comprises a sealing skirt surrounding the dispenser duct on at least a fraction of said height, said sealing skirt being suitable for bearing in leaktight manner against the pump body when the pushbutton is in its low position so as to isolate the vent from the outside, and wherein the piston is movable relative to the dispenser duct.

2. A pump according to claim 1, wherein the piston is not integral with the dispenser duct.

3. A pump according to claim 1, wherein the sealing skirt is made integrally with the pushbutton.

4. A pump according to claim 1, wherein the piston is arranged to isolate the vent when the pushbutton is in its high position.

5. A pump according to claim 4, wherein the piston has two annular sealing lips situated respectively above and below the vent when the pushbutton is in its high position.

6. A pump according to claim 1, wherein the dispenser duct is suitable for coming to bear against the shutter-forming member of the suction valve when the pushbutton is in its low position.

7. A pump according to claim 1, including a spring disposed in the pump chamber in such a manner as to exert a return force on the pushbutton urging it into its high position.

8. A pump according to claim 1, wherein the shutter-forming member of the suction valve is constituted by a ball retained in a cage formed integrally with the pump body, cage including at least one retention member that is elastically deformable and capable of deforming while the ball is being put into place.

9. A pump according to claim 1, wherein the dispenser duct is formed integrally with the piston and cannot move relative thereto.

10. A pump according to claim 1, wherein the dispenser duct includes a substance admission orifice opening out laterally, and wherein the piston is movable relative to the dispenser duct between a closed position in which it closes the admission orifice and a dispensing position in which it leaves the admission orifice disengaged.

11. A pump according to claim 10, wherein the dispenser duct has a top abutment suitable for limiting upward displacement of the piston relative to the dispenser duct, and a bottom abutment suitable for limiting downward displacement of the piston relative to the dispenser duct, and wherein one of the top and bottom abutments is configured to allow the piston to go past it while the piston is mounted on the dispenser duct.

12. A pump according to claim 11, wherein the top abutment is suitable for allowing the piston to go past it when the piston is moved towards the bottom abutment while the piston is mounted on the dispenser duct.

13. A pump according to claim 1, wherein the pump body is formed integrally with an assembly skirt enabling it to be fixed on the receptacle.

14. A pump according to claim 1, wherein the pump body is provided with a first retaining member, and the pushbutton is provided with a second retaining member suitable for co-operating with the first retaining member to hold the pushbutton in its low position during storage.

15. A pump according to claim 1, wherein the dispenser duct is not integral with the said pushbutton and is attached thereto.

16. A receptacle fitted with a pump as defined in claim 1.

17. A pump according to claim 1, wherein the sealing skirt does not contact the dispenser duct.

18. A method of manufacturing a pump comprising: a pump body for fixing on the receptacle and including at least one air intake vent; a pushbutton movable relative to the pump body between a low position and a high position; a suction valve including a shutter-forming member; a piston co-operating with the pump body to define a pump chamber of variable volume; and a dispenser duct through which the pump chamber can communicate with a dispenser orifice, the pushbutton further comprising a sealing skirt surrounding the dispenser duct on at least a fraction of its height, said sealing skirt suitable for bearing in leaktight manner against the pump body when the pushbutton is in its low position so as to isolate the vent from the outside, and the dispenser duct being constituted by an element attached to the pushbutton; the method comprising the following steps:

a) forming the sealing skirt integrally with the pushbutton; and b) attaching the dispenser duct to the pushbutton after mounting a piston on the dispenser duct that is movable relative to the dispenser duct.

19. A pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct having a height and through which the pump chamber can communicate with to a dispenser orifice;

wherein the pushbutton further comprises a sealing skirt surrounding the dispenser duct on at least a fraction of said height, said sealing skirt being suitable for bearing in leaktight manner against the pump body when the pushbutton is in its low position so as to isolate the vent from the outside, wherein the dispenser duct is attached to the pushbutton and not integral therewith, and wherein the high position of said pushbutton is determined by the cooperation of said pushbutton and said pump body.

20. A pump according to claim 19, wherein the piston is constituted by an attachment.

21. A pump according to claim 19, wherein the sealing skirt is made integrally with the pushbutton.

22. A pump according to claim 19, wherein the piston is arranged to isolate the vent when the pushbutton is in its high position.

23. A pump according to claim 22, wherein the piston has two annular sealing lips situated respectively above and below the vent when the pushbutton is in its high position.

24. A pump according to claim 19, wherein the dispenser duct is suitable for coming to bear against the shutter-forming member of the suction valve when the pushbutton is in its low position.

25. A pump according to claim 19, including a spring disposed in the pump chamber in such a manner as to exert a return force on the pushbutton urging it into its high position.

26. A pump according to claim 19, wherein the shutter-forming member of the suction valve is constituted by a ball retained in a cage formed integrally with the pump body, said cage including at least one retention member that is elastically deformable and capable of deforming while the ball is being put into place.

27. A pump according to claim 19, wherein the dispenser duct is formed integrally with the piston and cannot move relative thereto.

28. A pump according to claim 19, including a delivery valve comprising a shutter-forming member retained in a housing formed in the dispenser duct.

29. A pump according to claim 28, wherein the shutter-forming member of the delivery valve is constituted by a ball.

30. A pump according to claim 28, wherein the housing receiving the shutter-forming member of the delivery valve is situated in the top portion of the dispenser duct.

31. A pump according to claim 30, wherein the shutter-forming member of the delivery valve is free in its housing, and wherein the pushbutton forms a top seat for the shutter-forming member of the delivery valve, which member comes to bear against said top seat in the event of the receptacle being turned upside-down, in the event of the pressure outside the pump being negative, or in the event of substance being delivered too quickly, and wherein the dispenser duct forms a bottom seat against which the shutter-forming member of the delivery valve can come to bear when suction is established inside the pump chamber during normal operation of the pump.

32. A pump according to claim 30, wherein the shutter-forming member of the delivery valve is returned against a seat formed by the dispenser duct by means of a spring bearing against the pushbutton.

33. A pump according to claim 28, wherein the housing receiving the shutter-forming member of the delivery valve is situated in the bottom portion of the dispenser duct.

34. A pump according to claim 19, wherein the dispenser duct includes a substance admission orifice opening out laterally and wherein the piston is movable relative to the dispenser duct between a closed position in which it closes the admission orifice and a dispensing position in which it leaves the admission orifice disengaged.

35. A pump according to claim 34, wherein the dispenser duct has a top abutment suitable for limiting upward displacement of the piston relative to the dispenser duct, and a bottom abutment suitable for limiting downward displacement of the piston relative to the dispenser duct, and wherein one of the top and bottom abutments is configured to allow the piston to go past it while the piston is mounted on the dispenser duct.

36. A pump according to claim 35, wherein the top abutment is suitable for allowing the piston to go past it when the piston is moved towards the bottom abutment while the piston is mounted on the dispenser duct.

37. A pump according to claim 19, wherein the pump body is formed integrally with an assembly skirt enabling it to be fixed on the receptacle.

38. A pump according to claim 19, wherein the pump body is provided with a first retaining member, and the pushbutton is provided with a second retaining member suitable for co-operating with the first retaining member to hold the pushbutton in its low position during storage.

39. A pump according to claim 19, wherein the sealing skirt does not contact the dispenser duct.

40. A pump to dispense a substance contained in a receptacle, the pump comprising:

a pump body including at least one air intake vent;

a pushbutton movable relative to the pump body between a low position and a high position;

a suction valve including a ball;

a piston co-operating with the pump body to define a pump chamber of variable volume; and a dispenser duct attached to said pushbutton and not integral therewith, having a height and through which the pump chamber can communicate with a dispenser orifice;

wherein the pushbutton further comprises a sealing skirt surrounding the dispenser duct on at least a fraction of said height said sealing skirt being suitable for bearing in leaktight manner against the pump body when the pushbutton is in its low position so as to isolate the vent from the outside.

41. A pump according to claim 40, wherein the piston is not integral with the dispenser duct.

42. A pump according to claim 40, wherein the sealing skirt is made integrally with the pushbutton.

43. A pump according to claim 40, wherein the piston is arranged to isolate the vent when the pushbutton is in its high position.

44. A pump according to claim 43, wherein the piston has two annular sealing lips situated respectively above and below the vent when the pushbutton is in its high position.

45. A pump according to claim 40, wherein the dispenser duct is suitable for coming to bear against the shutter-forming member of the suction valve when the pushbutton is in its low position.

46. A pump according to claim 40, including a spring disposed in the pump chamber in such a manner as to exert a return force on the pushbutton urging it into its high position.

47. A pump according to claim 40, wherein the ball of the suction valve is retained in a cage formed integrally with the pump body, said cage including at least one retention member that is elastically deformable and capable of deforming while the ball is being put into place.

48. A pump according to claim 40, wherein the dispenser duct is formed integrally with the piston and cannot move relative thereto.

49. A pump according to claim 40, including a delivery valve comprising a shutter-forming member retained in a housing formed in the dispenser duct.

50. A pump according to claim 49, wherein the shutter-forming member of the delivery valve is constituted by a ball.

51. A pump according to claim 49, wherein the housing receiving the shutter-forming member of the delivery valve is situated in the top portion of the dispenser duct.

52. A pump according to claim 51, wherein the shutter-forming member of the delivery valve is free in its housing, and wherein the pushbutton forms a top seat for the shutter-forming member of the delivery valve, which member comes to bear against said top seat in the event of the receptacle being turned upside-down, in the event of the pressure outside the pump being negative, or in the event of substance being delivered too quickly, and wherein the dispenser duct forms a bottom seat against which the shutter-forming member of the delivery valve can come to bear when suction is established inside the pump chamber during normal operation of the pump.

53. A pump according to claim 51, wherein the shutter-forming member of the delivery valve is returned against a seat formed by the dispenser duct by means of a spring bearing against the pushbutton.

54. A pump according to claim 49, wherein the housing receiving the shutter-forming member of the delivery valve is situated in the bottom portion of the dispenser duct.

55. A pump according to claim 40, wherein the dispenser duct includes a substance admission orifice opening out laterally, and wherein the piston is movable relative to the dispenser duct between a closed position in which it closes the admission orifice and a dispensing position in which it leaves the admission orifice disengaged.

56. A pump according to claim 55, wherein the dispenser duct has a top abutment suitable for limiting upward displacement of the piston relative to the dispenser duct, and a bottom abutment suitable for limiting downward displacement of the piston relative to the dispenser duct, and wherein one of the top and bottom abutments is configured to allow the piston to go past it while the piston is mounted on the dispenser duct.

57. A pump according to claim 56, wherein the top abutment is suitable for allowing the piston to go past it when the piston is moved towards the bottom abutment while the piston is mounted on the dispenser duct.

58. A pump according to claim 40, wherein the pump body is formed integrally with an assembly skirt enabling it to be fixed on the receptacle.

59. A pump according to claim 40, wherein the pump body is provided with a first retaining member, and the pushbutton is provided with a second retaining member configured for co-operating with the first retaining member to hold the pushbutton in its low position during storage.

60. A pump according to claim 40, wherein the sealing skirt does not contact the dispenser duct.

61. A pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct attached to the pushbutton and not integral therewith, having a height and through which the pump chamber can communicate with a dispenser orifice of the dispensing duct;

wherein the pushbutton comprises a locking skirt capable of cooperating with said body to lock said pushbutton in said low position and a sealing skirt located between said locking skirt and said dispenser duct and surrounding said dispenser duct on at least a fraction of said height, said sealing skirt being suitable for bearing in leaktight manner against the pump body when the pushbutton is in its low position so as to isolate the vent from the outside.

62. A pump according to claim 61, wherein the piston is constituted by an attachment.

63. A pump according to claim 61, wherein the sealing skirt is made integrally with the pushbutton.

64. A pump according to claim 61, wherein the piston is arranged to isolate the vent when the pushbutton is in its high position.

65. A pump according to claim 64, wherein the piston has two annular sealing lips situated respectively above and below the vent when the pushbutton is in its high position.

66. A pump according to claim 61, wherein the dispenser duct is suitable for coming to bear against the shutter-forming member of the suction valve when the pushbutton is in its low position.

67. A pump according to claim 61, including a spring disposed in the pump chamber in such a manner as to exert a return force on the pushbutton urging it into its high position.

68. A pump according to claim 61, wherein the shutter-forming member of the suction valve is constituted by a ball retained in a cage formed integrally with the pump body, said cage including at least one retention member that is elastically deformable and capable of deforming while the ball is being put into place.

69. A pump according to claim 61, wherein the dispenser duct is formed integrally with the piston and cannot move relative thereto.

70. A pump according to claim 61, including a delivery valve comprising a shutter-forming member retained in a housing formed in the dispenser duct.

71. A pump according to claim 70, wherein the shutter-forming member of the delivery valve is constituted by a ball.

72. A pump according to claim 70, wherein the housing receiving the shutter-forming member of the delivery valve is situated in the top portion of the dispenser duct.

73. A pump according to claim 72, wherein the shutter-forming member of the delivery valve is free in its housing, and wherein the pushbutton forms a top seat for the shutter-forming member of the delivery valve, which member comes to bear against said top seat in the event of the receptacle being turned upside-down, in the event of the pressure outside the pump being negative, or in the event of substance being delivered too quickly, and wherein the dispenser duct forms a bottom seat against which the shutter-forming member of the delivery valve can come to bear when suction is established inside the pump chamber during normal operation of the pump.

74. A pump according to claim 72, wherein the shutter-forming member of the delivery valve is returned against a seat formed by the dispenser duct by means of a spring bearing against the pushbutton.

75. A pump according to claim 70, wherein the housing receiving the shutter-forming member of the delivery valve is situated in the bottom portion of the dispenser duct.

76. A pump according to claim 61, wherein the dispenser duct includes a substance admission orifice opening out laterally, and wherein the piston is movable relative to the dispenser duct between a closed position in which it closes the admission orifice and a dispensing position in which it leaves the admission orifice disengaged.

77. A pump according to claim 76, wherein the dispenser duct has a top abutment suitable for limiting upward displacement of the piston relative to the dispenser duct, and a bottom abutment suitable for limiting downward displacement of the piston relative to the dispenser duct, and wherein one of the top and bottom abutments is configured to allow the piston to go past it while the piston is mounted on the dispenser duct.

78. A pump according to claim 77, wherein the top abutment is suitable for allowing the piston to go past it when the piston is moved towards the bottom abutment while the piston is mounted on the dispenser duct.

79. A pump according to claim 61, wherein the pump body is formed integrally with an assembly skirt enabling it to be fixed on the receptacle.

80. A pump according to claim 61, wherein the pump body is provided with a first retaining member, and the pushbutton is provided with a second retaining member suitable for co-operating with the first retaining member to hold the pushbutton in its low position during storage.

81. A pump according to claim 61, wherein the sealing skirt does not contact the dispenser duct.

82. A pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct attached to the pushbutton and not integral therewith, having a height and through which the pump chamber can communicate with a dispenser orifice;

a delivery valve comprising a ball;

wherein the pushbutton comprises a sealing skirt surrounding the dispenser duct on at least a fraction of said height, said sealing skirt being suitable for bearing in leaktight manner against the pump body when the pushbutton is in its low position so as to isolate the vent from the outside.

83. A pump according to claim 82, wherein the piston is constituted by an attachment.

84. A pump according to claim 81, wherein the sealing skirt is made integrally with the pushbutton.

85. A pump according to claim 81, wherein the piston is arranged to isolate the vent when the pushbutton is in its high position.

86. A pump according to claim 85, wherein the piston has two annular sealing lips situated respectively above and below the vent when the pushbutton is in its high position.

87. A pump according to claim 81, wherein the dispenser duct is suitable for coming to bear against the shutter-forming member of the suction valve when the pushbutton is in its low position.

88. A pump according to claim 81, including a spring disposed in the pump chamber in such a manner as to exert a return force on the pushbutton urging it into its high position.

89. A pump according to claim 81, wherein the shutter-forming member of the suction valve is constituted by a ball retained in a cage formed integrally with the pump body, said cage including at east one retention member that is elastically deformable and capable of deforming while the ball is being put into place.

90. A pump according to claim 81, wherein the dispenser duct is formed integrally with the piston and cannot move relative thereto.

91. A pump according to claim 81, wherein said ball of said delivery valve is retained in a housing formed in the dispenser duct.

92. A pump according to claim 91, wherein the housing receiving the ball of the delivery valve is situated in the top portion of the dispenser duct.

93. A pump according to claim 92, wherein the all of the delivery valve is free in its housing, and wherein the pushbutton forms a top seat for said ball of the delivery valve, which member comes to bear against said top seat in the event of the receptacle being turned upside-down, in the event of the pressure outside the pump being negative, or in the event of substance being delivered too quickly, and wherein the dispenser duct forms a bottom seat against which the ball of the delivery valve can come to bear when suction is established inside the pump chamber during normal operation of the pump.

94. A pump according to claim 92, wherein the ball of the delivery valve is returned against a seat formed by the dispenser duct by means of a spring bearing against the pushbutton.

95. A pump according to claim 91, wherein the housing receiving the ball of the delivery valve is situated in the bottom portion of the dispenser duct.

96. A pump according to claim 81, wherein the pump body is formed integrally with an assembly skirt enabling it to be fixed on the receptacle.

97. A pump according to claim 81, wherein the pump body is provided with a first retaining member, and the pushbutton is provided with a second retaining member suitable for co-operating with the first retaining member to hold the pushbutton in its low position during storage.

98. A pump to dispense a substance contained in a receptacle, the pump comprising:

a pump body including at least one air intake vent;

a pushbutton movable relative to the pump body between a low position and a high position;

a suction valve including a shutter-forming member;

a piston co-operating with the pump body to define a pump chamber of variable volume; and a dispenser duct having a height and through which the pump chamber can communicate with a dispenser orifice, said dispenser duct including a substance admission orifice opening out laterally, wherein the pushbutton further comprises a sealing skirt surrounding the dispenser duct on at least a fraction of its said height, said sealing skirt being suitable for bearing in leaktight manner against the pump body when the pushbutton is in its low position so as to isolate the vent from the outside, wherein the piston is movable relative to the dispenser duct between a closed position in which it closes the admission orifice and a dispensing position in which it leaves the admission orifice disengaged, wherein the dispenser duct has a top abutment suitable for limiting upward displacement of the piston relative to the dispenser duct, and a bottom abutment suitable for limiting downward displacement of the piston relative to the dispenser duct, and wherein one of the top and bottom abutments is configured to allow the piston to go past it while the piston is mounted on the dispenser duct.

* * * * *

UNITED STATES PATENT AND TRADEMARK OFFICE

CERTIFICATE OF CORRECTION

PATENT NO. : 6,726,064 B2
DATED : April 27, 2004
INVENTOR(S) : Philippe Bonningue It is certified that error appears in the above-identified patent and that said Letters Patent is hereby corrected as shown below:

Column 9,
Line 39, before “cage” please insert therefor -- said --

Column 10,
Line 38, please delete “to”.
Line 52, please delete “claim 19” and insert therefor -- claim 20 --.

Column 15,
Lines 25, 27, 33, 37, 41, 47 and 50, please delete “claim 81” and insert therefor -- claim 82 --.
Line 56, please delete “all” and insert therefor -- ball --.

Column 16,
Lines 17 and 20, please delete “claim 81” and insert therefor -- claim 82 --.

Signed and Sealed this

Second Day of November, 2004

JON W. DUDAS
*Director of the United States Patent and Trademark Office*